United States Patent [19]

Martinelli

[11] 3,957,089

[45] May 18, 1976

[54] LOOM OF THE SHUTTLELESS TYPE

[76] Inventor: Giovanna Martinelli, Via Tonale, 14, Leffe. (Bergamo), Italy

[22] Filed: Sept. 16, 1974

[21] Appl. No.: 506,628

[30] Foreign Application Priority Data

Sept. 24, 1973 Italy ..... 29273/73

[52] U.S. Cl. ..... 139/448; 139/188 R

[51] Int. Cl.[2] ..... D03D 47/18; D03D 47/20

[58] Field of Search ..... 139/122 R, 122 N, 123, 139/125, 126, 127, 188

[56] References Cited

UNITED STATES PATENTS

| | | | |
|---|---|---|---|
| 2,548,663 | 4/1951 | Fletcher et al. | 139/123 |
| 3,114,398 | 12/1963 | Pfarrwaller | 139/188 |
| 3,438,402 | 4/1969 | Kokkinis | 139/122 |
| 3,578,031 | 5/1971 | Maassen | 139/122 |

*Primary Examiner*—James Kee Chi

*Attorney, Agent, or Firm*—Guido Modiano; Albert Josif

[57] ABSTRACT

An improved loom of the shuttleless type, which comprises for each weft inserter a magnetic guiding device mounted in the slay of the loom and having a ferromagnetic core, of elongated shape, with a coil wound longitudinally around the core. A pair of plates is engaged longitudinally on the opposite sides of the core and laterally delimiting the coil. The plates are positioned in planes perpendicular to the upper base of the slay and face a direction parallel to the direction of motion of the weft inserters. There are also provided a pair of non magnetic spacing plate members placed between the plates so as to define together with the plates themselves a rectangular housing within which is enclosed said coil. The plates thus define with their edges past the spacing plates, as the current passes through the coil, a magnetic guiding path within which run the weft inserters moving over the slay of the loom.

3 Claims, 8 Drawing Figures

A
B

LOOM OF THE SHUTTLELESS TYPE

BACKGROUND OF THE INVENTION

The present invention relates to an improved loom of the structure of the takeup gripper head and the guiding device for guiding the gripper head with the weft thread through the shed.

As is well known, there are looms, which use a pair of members called weft carrying gripper head and takeup gripper head, in place of the traditional shuttle which slides along the entire shed.

Each of these members covers half of the shed length, symmetrically approaching one another and carrying out a yarn exchange in the instant they meet and then moving away from one another.

With these members a swifter operation is obtainable than with traditional shuttles. In fact the weft carrying gripper head and the takeup gripper head can be very fast in that they each have a mass, and therefore an inertia, which are very reduced.

However a technical but very delicate problem arises typical of these looms. In fact, in order for the loom to operate, it is necessary to obtain a perfect alignment between the sliding path of the takeup gripper head and that of the weft carrying gripper head, otherwise occasionally the loom idles since the head fails to grasp the weft yarn.

SUMMARY OF THE INVENTION

The main object of the present invention is to provide an improvement of looms presently produced, by completely and satisfyingly resolving the stated technical problem.

Another object of the present invention is to provide a takeup gripper head for the weft yarn which is particularly simple and light and moreover structured in such a way as to assure a safe grasp of the yarn without damaging the warp between which it runs.

A further object of the invention is to provide devices which can be applied to a major part of existing looms and which are also easily and rapidly producible.

These and other objects are attained by an improved loom of the shuttleless type according to the invention, comprising for the weft carrying gripper head and the takeup gripper head, each a magnetic guiding device mounted in the slay of the loom and having a ferromagnetic core, of elongated shape, a coil wound longitudinally around said core, a pair of plates engaged longitudinally on the opposite ends of said core and laterally delimiting said coil, said plates being positioned in planes perpendicular to the upper base of the slay and facing a direction parallel to the direction of motion of the weft carrying gripper head and the takeup gripper head, a pair of non magnetic spacing plates placed between said plates so as to define together with the plates themselves a rectangular housing within which is enclosed said coil, said plates thus defining with their edges projecting past said spacing plates, as the current passes through the coil, a magnetic field guiding the weft carrying gripper head and the takeup gripper head moving over the slay of the loom.

BRIEF DESCRIPTION OF THE INVENTION

Further characteristics and advantages will be more evident from a detailed description of a loom according to the invention illustrated by way of an indicative example in the accompanying drawing in which.

Figures 1, 2, 3, 4, 5, 6, 7:
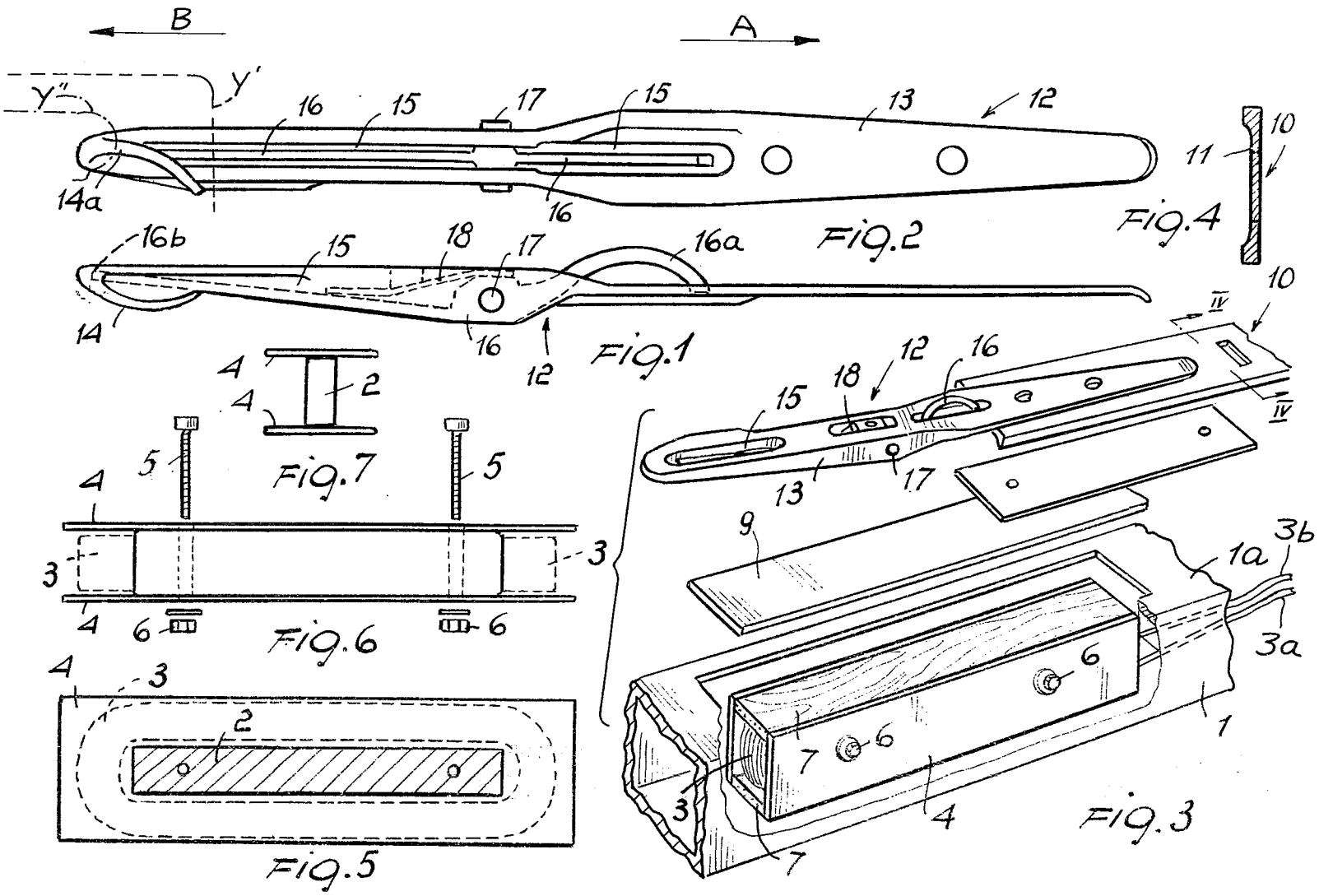
FIG. 1 is a lateral view of the takeup gripper head.
FIG. 2 is a view from below of what is shown in FIG. 1.
FIG. 3 shows perspectively as a unit the takeup gripper head and the device for guiding the motion of the takeup gripper head itself.
FIG. 4 is a section along the line IV—IV of FIG. 3.
FIG. 5 shows diagrammatically the guiding device for the takeup gripper head.
FIG. 6 is a view from below of FIG. 5.
FIG. 7 is a lateral view of FIG. 6.

The mentioned FIGS. show only the members essential to the understanding of the present invention, whereas those parts, which are known to people skilled in the art and which therefore are not of interest in the present invention, have been eliminated.

DESCRIPTION OF A PREFERRED EMBODIMENT

In the improved loom according to the present invention, there are two guiding devices, of which only one is shown, one for the weft carrying gripper head and one for the takeup gripper head which, as is known, slide with alternating motion along the slay 1. Each guiding device is mounted in a box-like portion of the slay 1; slay is of magnetic type and comprises essentially a ferromagnetic core 2 shaped substantailly like a parallelepiped, a coil 3, in which current may be passed, wound around the core 2 within the space delimited by a pair of lateral plates 4 fixed, by means of screws 5 and nuts 6, on the opposite sides of the core 2. It will be evident that the coil 3 is connectable to a source of electric current through conventional means, not shown. The plates 4 are arranged along planes parallel to the direction of advancement of the weft carrying gripper head and the takeup gripper-head and are perpendicular to the upper base 1*a* of the slay 1.

Similarly to the core 2, also the plates 4 are of ferromagnetic material, e.g. soft iron. Between the plates 4, on opposite sides of the coil 3, there are two spacing plates 7 of non-magnetic material, e.g. wood, which define together with the plates 4 a rectangular housing within which is enclosed the coil 3. The cables connecting electrically the coil 3 are schematically indicated in 3*a* and 3*b*.

The spacing plates 7 are arranged so as to allow the edges of the plates 4 to remain uncovered. Each magnetic guiding device, as stated, is inserted within a box-like portion of the slay 1, which is usually made of synthetic material e.g. laminated plastic material known under the commercial name "formica", and for this purpose a lid 9 is provided for opening the box-like portion of the slay 1.

Each magnetic guiding device is positioned beneath a weft carrying gripper head and a takeup gripper head near to the center point of the shed where said heads exchange the weft yarn. As is well known, said heads are moved by flexible propelling bands 10, attached to them in a known way. These flexible propelling bands 10, according to a new improvement, have beneath a central undercutting 11. While the weft carrying gripper head is of conventional type and is therefore not described here in detail, the take-up gripper head is described hereinafter more in detail.

According to the present invention, the takeup gripper head 12 consists of a main element 13, of elongated shape and substantially flat, which has on its front a hook like appendix 14 bend backwards, that is towards the rear part of the main element, and laterally, so as to form a sort of twisted hook, as clearly visible in FIG. 2.

Along the longitudinal axis of symmetry of the main element, there is a cavity 15, in which is housed a rod-like element 16 pivotably engaged within the cavity 15 by means of a pin 17 whose axis is inserted in a plane parallel to the one defined by surface on which slides the traction head 12 and perpendicular to the direction of advancement of the traction head 12. The rod-like element 16 is shaped so as to project with its rear end 16*a* above the main element 13. On its front part 16*b* instead it engages in a jaw like manner the hook formed by the appendix 14. The rod-like element 16 can oscillate 14*a* around its pin 17 so that its front end 16*b* can engage the root portion of the hood formed by the appendix 14 so as to form therewith an openable grip for a weft yarn brought by the weft carrying head (not shown) of the loom. The rod-like element 16 is spring biased by a resilient blade 18 fixed to the main element 13 and urging the element 13 against the hook.

The operation of the described device is the following.

Figure 8:
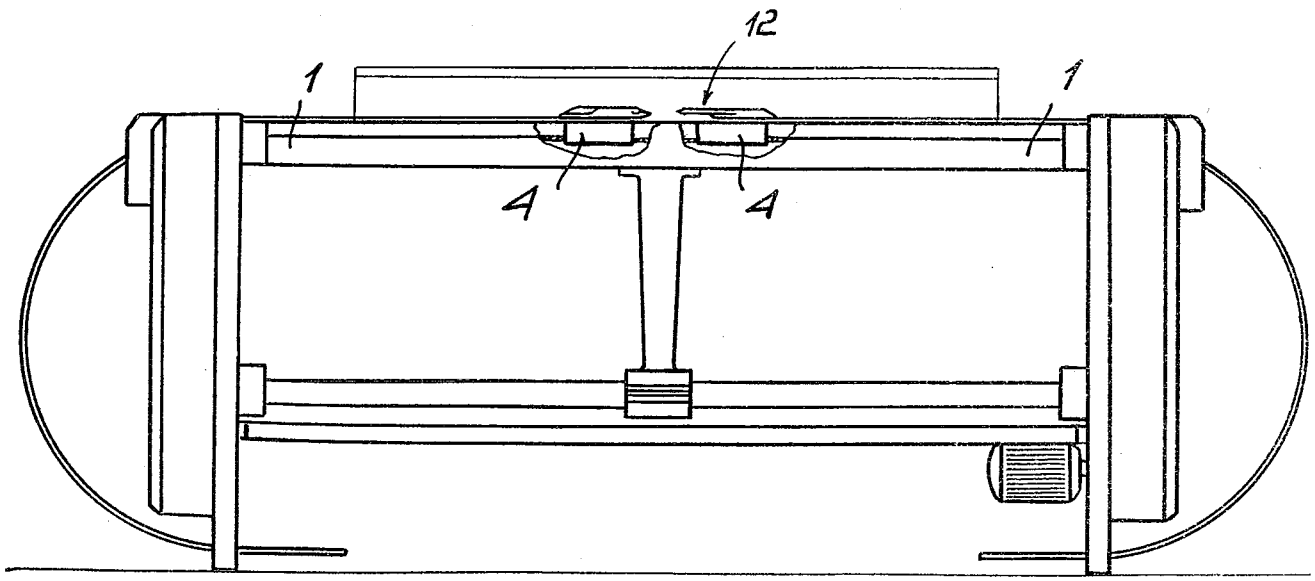
FIG. 8 is a schematic front view in elevation of a loom including the apparatus of the present invention.

The weft carrying gripper head and the takeup gripper head slide along the shed, each covering about half of the shed. Their movements are synchronized so they they both approach each other simultaneously at the center of the shed to exchange the weft yarn. The advancing and backwards motion i.e. the reciprocating motion of the gripper heads is provided each by a per se known propelling band 10 which, thanks to its central undercutting, advantageously exerts a minimum friction on the warp yarn and may therefore freely slide without damaging the warp yarn itself. The perfect alignment during the final stage of the approach of the guide and traction head to the center of the shed, is obtained, as has been said, by means of magnetic guiding devices positioned beneath the final part of the path of each head FIG. 8. In fact when a current passes through the coils 3, the edges of the plates 4 provide two magnetic fields which act as a magnetic guide for the heads, maintaining them within a precise path.

The magnetic action may cease during the return of the gripper heads, since an inaccuracy in the course in this case does not cause any inconvenience. For the purpose conventional electronic sensors are provided which activate and disactivate the electric circuit of the coils 3 in response to the passage of the gripper head past the sensor. The magnetic guiding devices are situated within the slay 1 and ensure that no disturbance is caused to the operation of the loom, without however hindering the action of the magnetic field which freely passes through the "formica". In addition, the takeup gripper head 12 is originally structured so as to be more simple and functional than the one already known. In fact for the gripping action it does not necessitate the yarn-opeining device that is the hook guard device, which, as is well known to people skilled in the art, is a cause of damage to the ware yarn. The appendix 14 is bent like a hook twisted laterally so as to allow the insertion of the yarn between the yielding spring biased rod-like element 16 and the eyelet formed by the hook itself, without however having to interrupt the linear course of the rod-like element 16 with deviations. The point 16*b* of the latter is protected by the appendix 14 against front interferences with the fabric and moreover, since it is able to insert itself within said hook almost at the most projecting section, it can act as a valid hindrance to the undesired hooking of warp yarns. The opening action of the hook, exerted by acting on the spring biased rod-like element 16, which by small rotations about its pin 17 displaces the position of its point, is caused by the engagement of the projecting end of the rod-like element with an appropriate cam of the loom, not shown, for the purpose to release the yarn from the grip. The rod-like element is also actuated by the yarn itself in the following conventional manner. The yarn is brought in position Y' (FIG. 2) by the weft carrying gripper head with an end portion stretched transverse to the path of the gripper head as shown in Y' in dotted line. The take-up gripper head 12 is then moved according to the arrow A, while the yarn is moved by the not shown weft carrying gripper head in the direction of arrow B. The stretched transverse portion of the yarn is brought thus into the nip defined by the appendix 14 and the spring biased pivotable rod-like element 16. Then the yarn is released in the known manner by the weft carrying yarn and is maintained pinched by the gripper 12 in the position Y'' shown in dash and dot line with a sufficient strength to drag it with the take-up gripper head in the direction of arrow A until the end of stroke position of this gripper head where the yarn end is released as above described.

The invention conceived as such, attains the proposed objects and a remarkable improvement in existing looms. It is susceptible to numerous modifications all included within the scope of the present inventive concept. Furthermore all the details may be substituted by other technically equivalent elements. In practice the materials and the dimensions used by be any, according to the necessity.

I claim:

1. In a shuttleless loom of the type having a slay of which at least a portion has a hollow box-like shape with at least one substantially plane wall surface and a pair of gripper heads reciprocating in opposite directions symmetrically with respect to a point of interengagement thereof, the reciprocating movement occurring along a path extending through a shed formed by warp threads and substantially parallel to said plane wall surface, flexible propelling bands for said gripper heads having their free extremities connected to said gripper heads for imparting reciprocating motion thereto, the improvement comprising a pair of magnetic guiding devices for each gripper head near said point of interengagement thereof, each comprising within said hollow box-like shaped portion of the slay, an elongated ferromagnetic core having longitudinally extending opposite lateral sides, a pair of spaced plate members connected to said opposite lateral sides of said core and extending perpendicular to said at least one plane wall surface and parallel to said path, said pair of spaced plates extending parallel to the beyond at least one portion of said lateral sides of said core, thereby to form a free annular space therebetween, a coil wound longitudinally around said core substantially within said free annular space, a pair of non magnetic covering plate members connected to and arranged between longitudinal edge portions of said spaced plate members and extending perpendicular to said pair of spaced plate members and covering a longitudinal extension of said annular space, thereby to provide a magnetic field guiding said gripper heads along said path near said point of interengagement when an electric current is caused to pass through said coil.

2. The combination of claim 1, wherein one of the gripper heads is a takeup gripper head including at its forward end a backwardly bent hook formation cooperating with a spring biased pivotable hook locking element, wherein according to the improvement said backwardly bent hook formation is laterally twisted.

3. The combination of claim 1, wherein said flexible propelling bands have an undercut on one side thereof.

* * * * *